United States Patent [19]

Sommer

[11] 4,186,578

[45] Feb. 5, 1980

[54] TAMPER PREVENTING LOCK

[76] Inventor: Frederick A. Sommer, 4238 Sibley Ave., Cincinnati, Ohio 45236

[21] Appl. No.: 867,815

[22] Filed: Jan. 9, 1978

[51] Int. Cl.[2] ..... E05B 17/00

[52] U.S. Cl. ..... 70/419; 70/431; 70/441

[58] Field of Search ..... 70/DIG. 49; 70/277, 70/278, 416, 419, 421, 431, 441, DIG. 46, DIG. 49; 200/42, 44, 61.66

[56] References Cited

U.S. PATENT DOCUMENTS

| | | | |
|---|---|---|---|
| 2,057,301 | 10/1936 | Golokow | 200/61.66 |
| 2,105,304 | 1/1938 | Wagner | 200/61.66 |
| 3,392,558 | 7/1968 | Hedin | 70/434 |
| 3,801,755 | 4/1974 | Schlage | 200/44 |

*Primary Examiner*—Robert L. Wolfe
*Attorney, Agent, or Firm*—Frost & Jacobs

[57] ABSTRACT

A tamper preventing tumbler lock which provides an alarm signal or prevents lock activation when any electrically conductive object, such as a pick or the like, is inserted in the keyway. The lock includes a pair of electrically conductive tumblers which complete an electrical path to activate the alarm or to activate a solenoid operated latch to prevent rotation of the lock cylinder or actuate an associated lock bolt when the conductive tumblers are bridged by the conducting object in the keyway. The lock may be operated as a conventional tumbler lock by means of an electrically non-conductive key.

11 Claims, 7 Drawing Figures

TAMPER PREVENTING LOCK

BACKGROUND OF THE INVENTION

1. Field of the Invention

The present invention relates generally to tumbler locks and more particularly to a tumbler lock having tamper preventing and indicating features.

2. Description of the Prior Art

It is well known that locks, particularly the tumbler locks of the less expensive variety such as pin tumbler, wafer tumbler and disc tumbler, can be defeated by the manipulation of a properly constructed pick inserted in the lock keyway. Various types of tamper preventing mechanisms, such as wards or milled or corrugated keyways have been proposed to make it more difficult for such locks to be successfully opened by means other than a properly coded key.

Inasmuch as prior art lock mechanisms have been unable to distinguish between authorized and unauthorized objects inserted in the lock keyway, there have heretofore been no satisfactory proposals for detecting a tamper attempt and providing a suitable response such as activating an alarm or inhibiting further lock movement. Furthermore, it has often been found desirable to provide such a response from the very instant the tamper attempt begins, rather than after the lock has been opened.

SUMMARY OF THE INVENTION

The present invention provides a tamper preventing lock which produces an alarm signal or prevents lock actuation when any electrically conductive object, such as a pick or the like, is inserted in the keyway. The lock is otherwise operable as a conventional lock by means of an electrically non-conductive key. Since it has been found that lock picks constructed of a particular non-conductive material, such as plastic, lack sufficient strength to work the lock activating mechanism, practical lock picks must necessarily be constructed of a metallic or electrically conductive material which, when inserted in the lock keyway, will cause the lock of the present invention to produce a response. Furthermore, metallic or conducting keys, even if cut with the proper code, will not operate the lock of the present invention.

In its simplest form, the tamper preventing lock resembles a standard pin tumbler lock comprising a shell housing having a cylinder core accepting bore therein. The housing includes a plurality of cylindrical driver accepting apertures in parallel spaced relationship communicating at one end with the bore. A cylinder core is rotatably mounted within the housing bore and contains a keyway adapted to receive a key as well as a plurality of cylindrical driver receiving apertures in parallel spaced relationship communicating at one end with the keyway.

A cylindrical pin-like driver is slidingly received within each of the housing apertures and extends into the core apertures when the locks is in a locked position. At least two of these drivers, preferably those nearest the keyway opening, are electrically conductive and are electrically insulated from each other by constructing the portion of the core and housing adjacent the apertures of an electrically conductive material, or by constructing the entire core and housing of an electrically non-conductive material.

Means are provided in association with the core and the drivers for moving the drivers out of the core apertures upon insertion into the keyway of a properly coded key so that the core may be rotated to place the lock in an unlocked position. In the case of a pin tumbler lock, this moving means would take the form of pins. In the case of disc tumbler and wafer tumbler locks, the moving means would be disc tumblers or wafer tumblers, respectively. In any of these configurations, the portions of the driver moving means associated with the conductive drivers are electrically conductive to form a pair of spaced electrical contacts positioned adjacent the keyway, such that when the contacts are bridged by an electrical conductor, such as a lock pick or the like, an electrical path is completed to produce the appropriate response to the tamper attempt.

The response may include a visual or audible alarm or means for preventing movement of the lock from a locked to an unlocked position as long as the contacts are bridged by the conductor. In the case of a tumbler lock, the movement preventing means acts to prevent rotation of the cylinder core. In one embodiment, the rotation preventing means comprises a cylinder cam non-rotatably secured to the end of the cylinder core and a slotted arm having a normal position wherein the arm permits movement of the cam relative thereto and an actuated position wherein the slotted arm engages the cam to prevent movement relative thereto. The arm may be actuated by a solenoid operable to move the arm from the normal to the actuated position when the electrical contacts are bridged by a conductor.

The arm may contain a keyhole-shaped slot comprising a circular-shaped opening adjoining an elongated opening. The cam comprises a connecting bar extending axially outwardly from the core and positioned within the slot, such that the bar is rotatable in the circular opening when the arm is in the normal position, with the bar being prevented from rotation within the elongated opening when the arm is moved linearly by the solenoid to the actuated position.

Alternatively, the arm may contain a slot extending inwardly from the cam engaging edge of the arm so that the slot is disengaged from the cam when the arm is in the normal position, with the solenoid being operable to rotate the arm so that the slot engages the cam to prevent cam movement when the arm is in the actuated position.

In a further refinement of the invention, the lock may include a bolt, such as a dead bolt or latch, slidably movable between an open and a closed position with a locking bar shiftable by means of a solenoid or the like, between the normal position to permit sliding movement of the bolt and an actuated position wherein the locking bar contacts the bolt to prevent sliding movement thereof when the contacts of the lock are bridged by a conductor.

In all of the embodiments, the lock is normally actuated by means of a properly coded key constructed from an electrically non-conductive material such as a plastic possessing the necessary mechanical strength. The operability of the lock, alarm and actuation preventing mechanism may be easily tested at any time by inserting a metallic key or other conducting object into the lock keyway.

DESCRIPTION OF THE PREFERRED EMBODIMENTS

Figure 1:
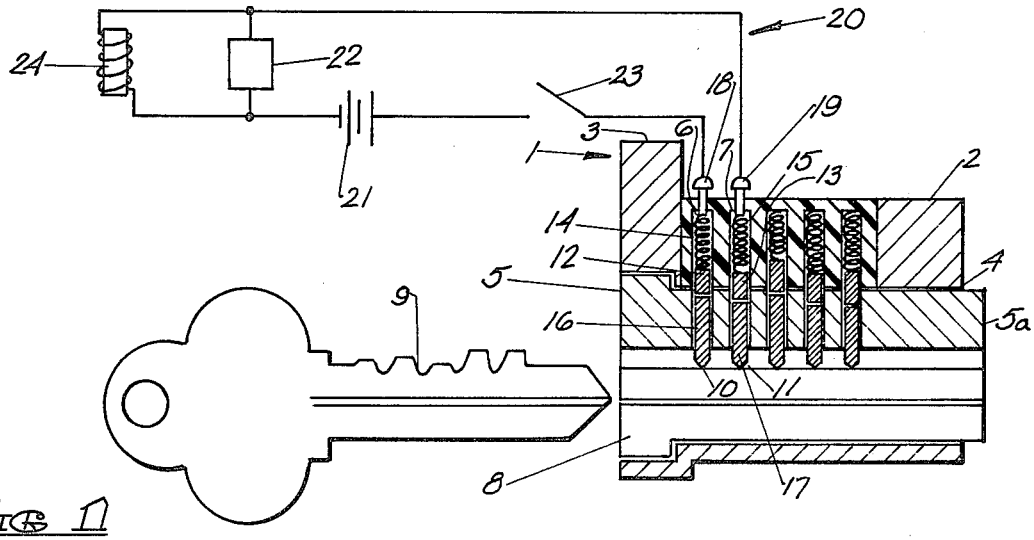
FIG. 1 is a side elevation cross sectional view of the tamper preventing lock of the present invention in association with a schematic representation of the alarm and actuation prevention circuit.

FIG. 1 represents a cross-sectional view of a tamper preventing pin tumbler lock, shown generally at 1, of the present invention. The lock comprises a substantially cylindrical shell housing 2 having a flange-like face plate 3 adapted to attach lock 1 to a door or the like as is well understood in the art. Housing 2 also contains an axial bore 4 for accepting a cylindrical cylinder core 5 as will be described hereinafter. Housing 2 further includes a plurality of parallel spaced apertures, two of which are at 6 and 7, respectively, which communicate at one end with axial bore 4.

Cylinder core 5 is rotatably mounted within axial bore 4 and contains a keyway 8 adapted to receive a properly coded key, shown at 9. In addition, core 5 contains a plurality of parallel spaced apertures, two of which are shown at 10 and 11, extending completely through the wall of core 5 and communicating at one end with keyway 8. Keyway 8 may be constructed in any suitable shape as is well understood in the art.

Each housing aperture contains a cylindrical pin-like driver, two of which are shown at 12 and 13 positioned within apertures 6 and 7, respectively. The drivers are free to slide within the housing apertures and are urged toward axial bore 4 by means of compression springs such as springs 14 and 15 illustrated in association with drivers 12 and 13. As is well understood in the art, the drivers are constructed of different lengths and extend into the core apertures when the lock is in a locked position.

Each of the core apertures contains a cylindrical pin, such as pins 16 and 17 shown received in apertures 10 and 11, which are free to slide within their respective apertures. The upper surface of each pin abuts the lower surface of its associated driver when the lock is in the locked position. The lower or keyway engaging end of each pin is V-shaped to engage the key bits. When a key 9 having the proper bitting is inserted into keyway 8, the pins and drivers will be moved within their respective apertures to produce a shear line along their interfaces so that core 5 may be rotated to place the lock in an unlocked position. An actuating mechanism may be provided in association with the rearmost surface 5*a* of core 5, such as a cam or connecting bar, to actuate the latch or bolt with which the lock is associated.

The foregoing pin tumbler construction and operation is substantially conventional and has been applied in connection with numerous lock designs. However, the present invention provides additional features and improvements which prevent unauthorized tampering with the lock mechanism.

In the construction of FIG. 1, drivers 12 and 13, compression springs 14 and 15, and pins 16 and 17 are constructed of a conducting material, such as copper, bronze, steel or the like. The upper or housing aperture engaging end of compression spring 14 terminates in a conducting terminal 18 which provides a point of connection exterior to housing 2. A similar terminal 19 is connected to the housing aperture engaging end of compression spring 15 and also extends beyond the outer surface of housing 2.

The conductive path formed through elements 12, 14, 16 and 18 is electrically insulated from the conductive path formed through elements 13, 15, 17 and 19 by constructing the portions of housing 2 abutting the housing apertures, and the portion of core 5 abutting the core apertures, of a non-conducting material, such as plastic or the like. Alternatively, housing 2 or core 5 may be constructed entirely of non-conducting materials. It will be understood that while the elements forming the two conductive paths have been described and illustrated as contained within the apertures closest to the entrance to keyway 8, the conductive elements may be contained within any adjacent or non-adjacent set of apertures.

In order to provide a response to unauthorized tampering with the lock, an alarm and actuating circuit, designated generally at 20, is connected between terminal 18 and 19 as shown in FIG. 1. Alarm and actuating circuit 20 comprises a source of power 21, which may be a battery or other power supply connected serially with an alarm 22. Alarm 22 may provide an audible or visual alarm signal, or a combination of both. in addition, a power disconnect switch 23 may be provided to disconnect power from alarm 22 when the tamper indicating feature is not desired or required. A solenoid 24, only the coil of which is shown, may be connected in parallel with alarm 22 to provide means for preventing lock actuation, as will be described hereinafter.

In operation, key 9 is constructed of any suitable non-conducting material, such as plastic, wood or an electrically conducting material covered with an electrically non-conducting coating, such as anodized aluminum or the like. Such a non-conducting key can be used in a conventional manner to unlock lock 1 while not causing activation of the alarm and actuation preventing mechanism. However, when an electrically conducting object, such as a lock pick or metallic key, is inserted into keyway 8 such that it bridges conducting pins 16 and 17, an electrical path will be completed to activate alarm 22 and solenoid coil 24. Alarm 22 and solenoid 24 may be so constructed as to remain activated only as long as the metallic object bridges the electrical contacts formed by pins 16 and 17. Alternatively, alarm 22 and solenoid 24 may continue to be activated until manually returned to their normal deenergized condition, after only brief conductive contact between pins 16 and 17.

Figure 2:
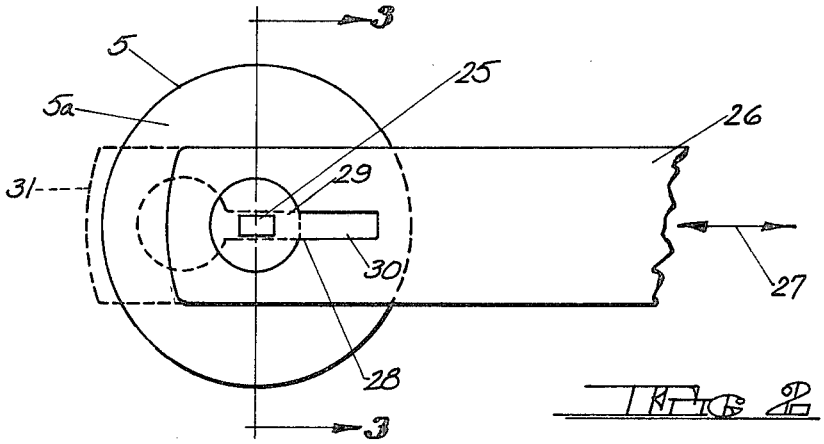
FIG. 2 is a fragmentary end view of the lock core illustrating a linearly activated preventing mechanism.
Figure 3:
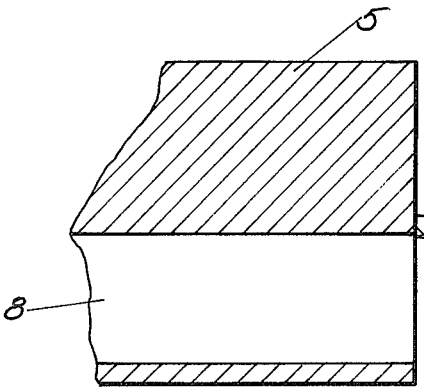
FIG. 3 is a fragmentary cross-sectional view taken along section line 3—3 of FIG. 2.

In addition to providing the alarm indication of unauthorized tampering of lock 1, the present invention also includes means for preventing lock activation induced by the presence of a conducting object in keyway 8 in contact with pins 16 and 17. A first embodiment of the actuation preventing means is illustrated in FIG. 2–FIG. 3 in connection with a lock of the type having a connecting bar 25 extending outwardly from the rearmost surface 5*a* of cylinder core 5. Connecting bar 25, of substantially rectangular cross section, is non-rotatably secured to cylinder core 5 and is normally utilized to actuate a lock latch or bolt, not shown. The actuation preventing means also includes an elongated slotted arm 26 in association with connecting bar 25 which is moved linearly in the directions shown by arrows 27 in FIG. 2 by means of solenoid 24. Arm 26 contains a keyhole shaped slot 28 including a circular shaped opening 29 adjoining an elongated opening 30. Circular opening 29 is so dimensioned that, in the unactuated position of arm 26 shown in FIG. 2, connecting bar 25 is free to rotate within opening 29. However, when an electrically conductive object bridges pins 16 and 17 so that solenoid 24 is energized, arm 26 is moved linearly to the position shown by dashed lines 31 such that connecting bar 25 is constrained within elongated slot 30. Elongated slot 30 is so dimensioned as to prevent rotation of connecting bar 25 therein, thus also preventing rotation of cylinder core 5. With the rotation of cylinder core 5 inhibited, the lock cannot be opened. When solenoid 24 is deenergized by either the removal of the conducting object from between pins 16 and 17, or by manually resetting the alarm in actuated circuit 20, arm 26 returns to its normal unactivated position and the lock 1 may be unlocked by a suitable non-conducting key 9.

Figure 4:
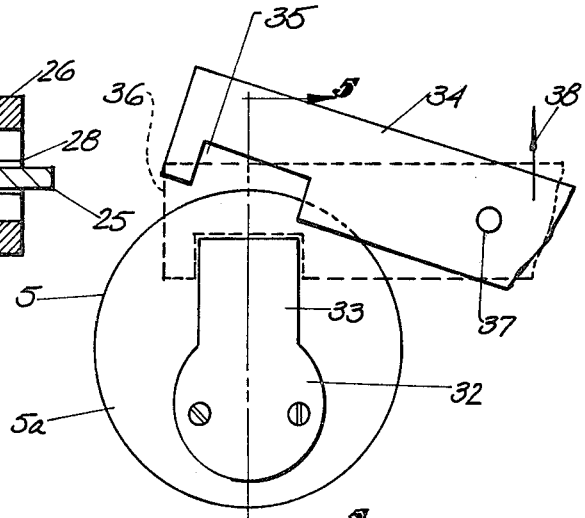
FIG. 4 is a fragmentary end view of the lock core illustrating a pivotally activated actuation preventing mechanism.
Figure 5:
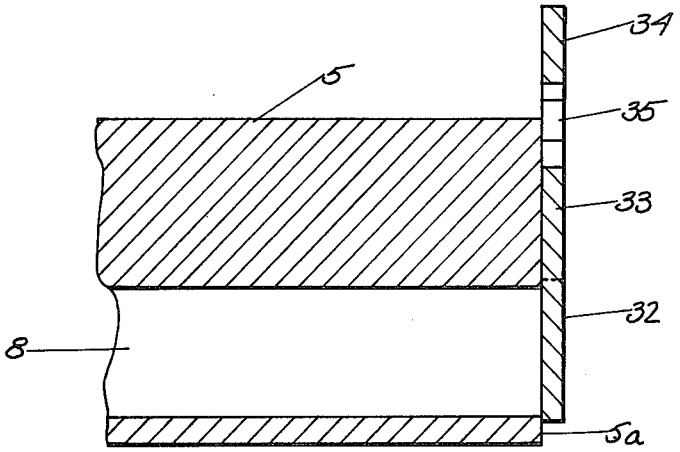
FIG. 5 is a fragmentary cross-sectional view taken along section line 5—5 of FIG. 4.

FIG. 4–FIG. 5 illustrate a second embodiment of the actuation preventing means of the present invention utilizing a conventional cylinder cam 32 non-rotatably secured to the rearmost surface 5*a* of cylinder core 5 as is well understood in the art. Cylinder cam 32 includes an upwardly extending tongue 33 which conventionally actuates a bolt or latch (not shown) as the cylinder core revolves. In this configuration, an elongated actuating arm 34 contains a substantially rectangular slot 35 in the tongue engaging edge of arm 34. Arm 34 is pivotably mounted so that in the normal unactuated position slot 35 is disengaged from tongue 33. However, when conducting pins 16 and 17 are bridged by a conductive object, arm 34 is caused to rotate by means of solenoid 24, which in this configuration may be either a rotary solenoid or a linearly actuated solenoid, to assume the position shown by the dashed lines 36 in FIG. 4, wherein slots 35 engage tongue 33 of cylinder cam 32 to prevent rotation of cylinder core 5 and thereby prevent lock 1 from being moved from the locked position. A rotary solenoid (not shown) may be connected to pivot point 37 of arm 34 to cause rotation between the normal and actuated positions of the arm. Alternatively, a linearly actuated solenoid (not shown), such as that used in the embodiment described hereinabove, may be connected to the end of arm 34 opposite the slot 35 so as to provide a linear force along the direction depicted by arrow 38 to move arm 34 between the normal and unactuated positions. It will be understood that in either of the embodiments of FIG. 2–FIG. 5, the generic term "cam" may be used to describe all types of actuating mechanisms exemplified by connecting bar 25 and cylinder cam 32.

Figure 6:
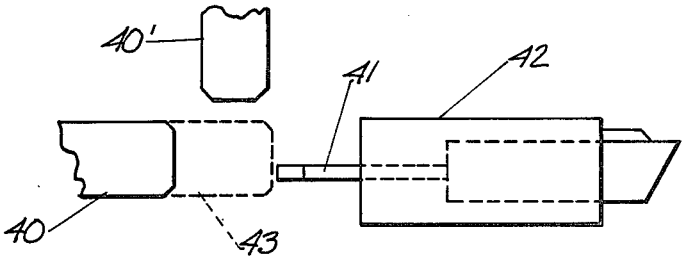
FIG. 6 is a fragmentary schematic representation illustrating an actuation preventing mechanism in association with a lock latch.

FIG. 6 illustrates another embodiment of the present invention wherein a locking bar 40, which it will be understood is connected to the armature of solenoid 24, may be used to prevent linear motion of the latch 41 associated with a conventional latch 42 in order to prevent latch operation. As shown in FIG. 6, locking bar 40 may be moved linearly from a position removed from latch bar 41, to an activated position shown by dashed lines 43 wherein locking bar abuts latch bar 41 to prevent movement thereof. Locking bar 40 may be positioned with respect to latch bar 41 so as to operate parallel thereto, or may be positioned perpendicularly to the direction of travel of latch bar 41, as at 40', to operate transverse latch bar 41.

Figure 7:
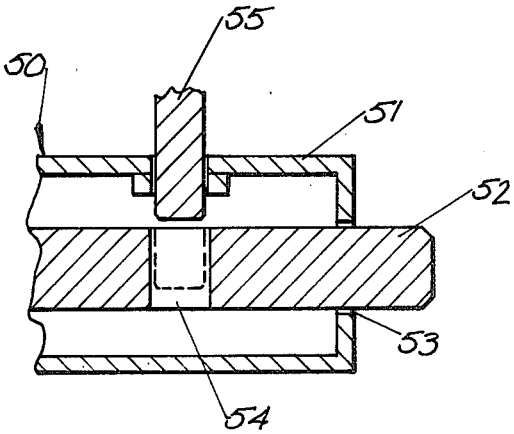
FIG. 7 is a fragmentary cross-sectional view of an actuation preventing mechanism in association with a dead bolt.

The embodiment of FIG. 7 illustrates the present invention in association with a dead bolt shown generally at 50. Dead bolt 50 comprises a box-like housing 51 which slidably supports a bolt 52 for sliding movement through an aperture 53 in housing 51. Bolt 52 also contains an aperture 54 located within housing 51 dimensioned to receive a locking bar 55 slidingly restrained in housing 51 for movement transverse to the direction of movement of bolt 52. Locking bar 55 is connected to the armature of solenoid 24 and assumes the normal unactuated position shown in FIG. 7, wherein locking bar 55 is disengaged from bolt aperture 54. When a conductive object bridges conducting pins 16 and 17, solenoid 24 is energized to move locking bar 55 into bolt aperture 54, thereby preventing linear movement of bolt 52. When solenoid 24 is deenergized, locking bar 55 may be withdrawn from within bolt aperture 54 to again enable bolt 52 actuation. It will be understood that in the embodiments of FIG. 6–FIG. 7, "bolt" may be used in its broadest sense to include the latch of FIG. 6 as well as the dead bolt of FIG. 7.

It will be further understood that various changes in the details, materials, steps and arrangements of parts which have been herein described and illustrated in order to explain the nature of the invention, may be made by those skilled in the art within the principle and scope of the invention as expressed in the appended claims. For example, while for purposes of an exemplary showing key 9 has been described as being constructed entirely of a non-conducting material, it will be understood that only that portion of key 9 which is capable of abutting conductive pins 16 and 17 need be made of such a non-conductive material. Furthermore, while the present invention has been described in connection with a tumbler lock, and particularly a pin tumbler lock, it will be understood that the inventive principles herein contained are readily extendable to other types of locks such as wafer tumbler, disc tumbler and the like.

The embodiments of the invention in which an exclusive property or privilege is claimed are defined as follows:

1. A tamper preventing lock comprising:

(a) a shell housing having a cylinder core accepting axial bore therein, said housing including a plurality of driver accepting apertures therein in parallel spaced relationships communicating at one end with said bore;

(b) a cylinder core rotatably mounted within said axial bore, said core containing a keyway adapted to receive a key and a plurality of driver receiving apertures therein in parallel spaced relationship communicating at one end with said keyway, (c) a pin-like driver slidably received in each of said housing apertures and extending into said core apertures when said lock is in a locked position, at least two of said drivers being electrically conductive and electrically insulated from each other;

(d) means in association with said core and said drivers for moving said drivers out of said core apertures upon insertion into said keyway of a properly coded key so that said core may be rotated to place said lock in an unlocked position, the portions of said driver moving means associated with said conductive drivers being electrically conductive to form an electrical path through said conductive drivers and said conductive part of said driver moving means when said conductive portions of said moving means are bridged by an electrical conductor, and (e) means in association with said core for preventing rotation thereof when said conductive portions of said moving means are bridged by an electrical conductor, ssaid rotation preventing means comprising a cam non-rotatably secured to the end of said core opposite the end of said core into which the key is inserted, a slotted arm in association with said cam having a normal position wherein said arm permits movement of said cam relative thereto and an actuated position wherein said arm engages said cam to prevent movement relative thereto, and solenoid means operable to move said arm from said normal position to said actuated position when said conductive portions of said moving means are bridged by an electrical conductor.

2. The lock according to claim 1 wherein the portion of said core adjacent said apertures receiving said conductive drivers is electrically non-conductive.

3. The lock according to claim 1 wherein the portion of said housing adjacent said apertures accepting said conductive drivers is electrically non-conducting.

4. The lock according to claim 1 including alarm means for providing an alarm when said conductive portions of said moving means are bridged by an electrical conductor.

5. The lock according to claim 1 wherein said arm contains a keyhole-shaped slot comprising a circular shaped opening adjoining an elongated opening and said cam comprises a connecting bar extending axially outwardly from said core and positioned within said slot, said bar being rotatable within said circular opening when said arm is in said normal position, said solenoid means being operable to linearly move said arm such that said bar is prevented from rotation within said elongated opening when said arm is in the actuated position.

6. The lock according to claim 1 wherein said arm contains a slot extending inwardly from the cam engaging edge of said arm, said slot being disengaged from said cam when said arm is in said normal position, said solenoid means being operable to rotate said arm so that said slot engages said cam to prevent cam movement when said arm is in the actuated position.

7. The lock according to claim 1 wherein said conductive portions of said moving means are positioned adjacent the entrance opening of said keyway.

8. The lock according to claim 1 including a properly coded key, the portion of said key adapted to contact said conductive portions of said moving means being electrically non-conductive.

9. A tamper preventing lock comprising:

(a) a shell housing having a cylinder core accepting axial bore therein, said housing including a plurality of driver accepting apertures therein in parallel spaced relationship communicating at one end with said bore;

(b) a cylinder core rotatably mounted within said axial bore, said core containing a keyway adapted to receive a key and a plurality of driver receiving apertures therein in parallel spaced relationship communicating at one end with said keyway, (c) a pin-like driver slidably received in each of said housing apertures and extending into said core apertures when said lock is in a locked position, at least two of said drivers being electrically conductive and electrically insulated from each other;

(d) means in association with said core and said drivers for moving said drivers out of said core apertures upon insertion into said keyway of a properly coded key so that said core may be rotated to place said lock in an unlocked position, the portions of said driver moving means associated with said conductive drivers being electrically conductive to form an electrical path through said conductive drivers and said conductive part of said driver moving means when said conductive portions of said moving means are bridged by an electrical conductor, and (e) a bolt slidably movable between an open and a closed position, and means to prevent sliding movement of said bolt when said conductive portions of said moving means are bridged by an electrical conductor, said movement preventing means including a locking bar shiftable between a normal position to permit sliding movement of said bolt and an actuated position wherein said locking bar contacts said bolt to prevent sliding movement thereof, said movement preventing means further including solenoid means operable to shift said locking bar between said normal and said actuated position.

10. The lock according to claim 9 including alarm means for providing an alarm when said conductive portions of said moving means are bridged by an electrical conductor.

11. The lock according to claim 9 including a properly coded key, the portion of said key adapted to contact said conductive portions of said moving means being electrically non-conductive.

* * * * *